United States Patent [19]

Lemal

[11] Patent Number: 4,584,844

[45] Date of Patent: Apr. 29, 1986

[54] HEAT PUMP

[75] Inventor: Clayton Lemal, Cumberland, Canada

[73] Assignee: Canadian Patents and Development Limited, Ottawa, Canada

[21] Appl. No.: 647,189

[22] Filed: Sep. 4, 1984

[30] Foreign Application Priority Data

Sep. 20, 1983 [CA] Canada ..... 437058

[51] Int. Cl.[4] ..... F25B 13/00

[52] U.S. Cl. ..... 62/160; 62/238.7; 62/324.1

[58] Field of Search ..... 62/324.1, 238.7, 160

[56] References Cited

U.S. PATENT DOCUMENTS

| | | | |
|---|---|---|---|
| 2,912,833 | 11/1959 | McGrath | 62/324.1 X |
| 2,928,255 | 3/1960 | Harnish | 62/324.1 X |
| 3,397,552 | 8/1968 | Harnish | 62/324.1 X |
| 4,104,890 | 8/1978 | Iwasaki | 62/324.1 |
| 4,343,157 | 8/1982 | Hattori | 62/160 |

*Primary Examiner*—Lloyd L. King

*Attorney, Agent, or Firm*—Ronald G. Bitner

[57] ABSTRACT

A heat pump system suitable for northern climates which utilizes a pressure limiting device that reduces pressure and capacity of the system in the cooling mode so as to allow a higher capacity in the heating mode for a given compressor-motor power rating. The pressure limiting device also alleviates problems associated with system reversal, such as for periodic outdoor heat exchanger defrosting.

1 Claim, 3 Drawing Figures

HEAT PUMP

BACKGROUND OF THE INVENTION

This invention relates to heat pumps and particularly to heat pumps suitable for northern climates which are subjected to a wide range of ambient temperatures.

Heat pumps are known which provide both heating and cooling. Heat pumps to be used in northern climates encounter special problems that have required additional complexity of construction to overcome. One of the main difficulties is that northern climates require high heating capacities and less cooling capacities while conventional heat pumps have nearly equal cooling and heating capacities. One prior approach to reducing the cooling capacity while maintaining high capacity in the heating mode involves the use of two compressor motors or a motor adapted to operate at a slower speed in the cooling mode. Another approach that has been prepared is to use a restrictor in conjunction with check valves that restricts flow in the cooling mode. These approaches add complexity and cost to the system and do not provide a desirable degree of adjustment of capacity for all temperature conditions with the result that the desired on-off cycling times and humidity control is not achieved.

Another inherent problem with heat pump occurs when the four-way reversing valve is switched, such as for defrosting the evaporator, or for changing from the heating mode to the cooling mode, or vice versa. At the moment the system is reversed, the compressor inlet pressure is higher than the outlet pressure which has two adverse effects on the system. One is that the reversed pressure causes the compressor to drive the electric motor momentarily which has undesirable electrical effects. The other is the danger of liquid refrigerant entering the compressor which can damage the compressor. The conventional method of dealing with this latter problem is the use of a suction line accumulator to trap the liquid.

SUMMARY OF THE INVENTION

It has been found that the difficulties referred to above can be overcome in a relatively simple manner by using a pressure limiting device in a certain manner in the heat pump system. Specifically, the pressure limiting device is serially connected to the inlet of the compressor operative to limit the compressor inlet pressure to a predetermined maximum pressure limit, said predetermined maximum pressure limit falling within the operating range of the system in the heating mode but less than the operating pressures of the cooling mode whereby pressure and capacity is reduced for all operation in the cooling mode and in a higher ambient temperature range in the heating mode and whereby the pressure and capacity are unaffected in a lower ambient temperature range of the heating mode.

The use of the present pressure limiting device for pressure and capacity reduction provides a simple and effective means of limiting the loading of the compressor motor at high ambient temperatures in the cooling mode while maintaining high capacity for low ambient temperatures in the heating mode. Also, the pressure limiting in the intermediate temperature range provides reduced on-off cycling and improved humidity control for the cooling mode. The previously mentioned problems caused when reversing the system are effectively avoided since the pressure limiting device is activated immediately by the high pressure, shutting off input to the compressor and thereby preventing the entry of liquid to the compressor. As the compressor reduces its inlet pressure, the pressure regulating device will gradually open until the system pressure is established.

DESCRIPTION OF THE PREFERRED EMBODIMENTS

Figure 1:
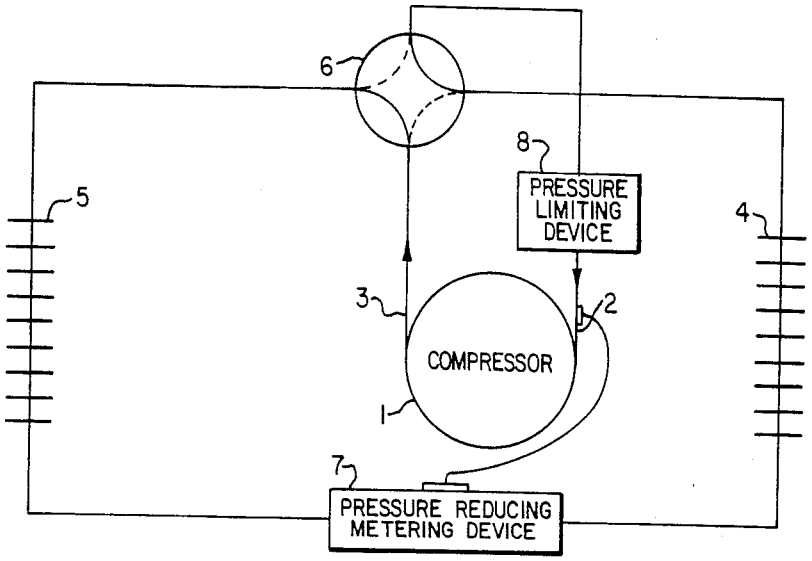
FIG. 1 is a schematic illustration of a heat pump system incorporating the present invention.

Referring to FIG. 1, the heat pump system comprises a compressor 1 having an inlet 2 and outlet 3, an indoor heat exchanger 4, an outdoor heat exchanger 5, a four-way reversing valve 6 and a pressure reducing metering device 7. In accordance with the present invention, a pressure limiting device 8 is serially connected to the inlet of the compressor. The pressure limiting device 8 is adapted to limit the pressure in the system to a predetermined maximum limit, wherein the limit falls within the operating pressure range encountered by the system in the heating mode but less than the operating pressures of the cooling mode.

Figure 2:
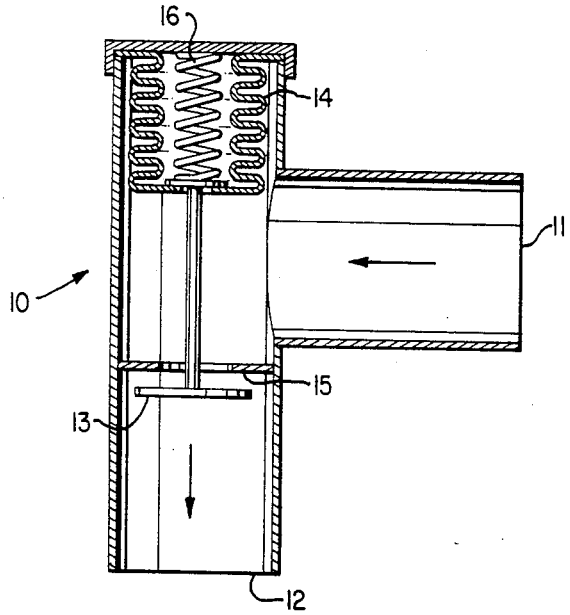
FIG. 2 is a sectional view of one embodiment of a pressure limiting device suitable for the heat pump system of the present invention.

One embodiment of the pressure limiting device is shown in FIG. 2. The device 10 comprises an inlet 11 and outlet 12 for connection to the inlet of the compressor as shown in FIG. 1. The pressure limiting device 10 includes a valve 13 connected to bellows 14. Valve 13 is biased open from seat 15 by spring 16. The pressure limit at outlet 12, and hence the compressor inlet, is determined by the force of spring 16. While the pressure at outlet 12 is greater than the predetermined limit, the valve will remain closed. As the outlet pressure is reduced, the valve will open and pass refrigerant into the compressor. An increase in the outlet pressure will cause the valve to throttle flow to provide the predetermined pressure limit.

Figure 3:
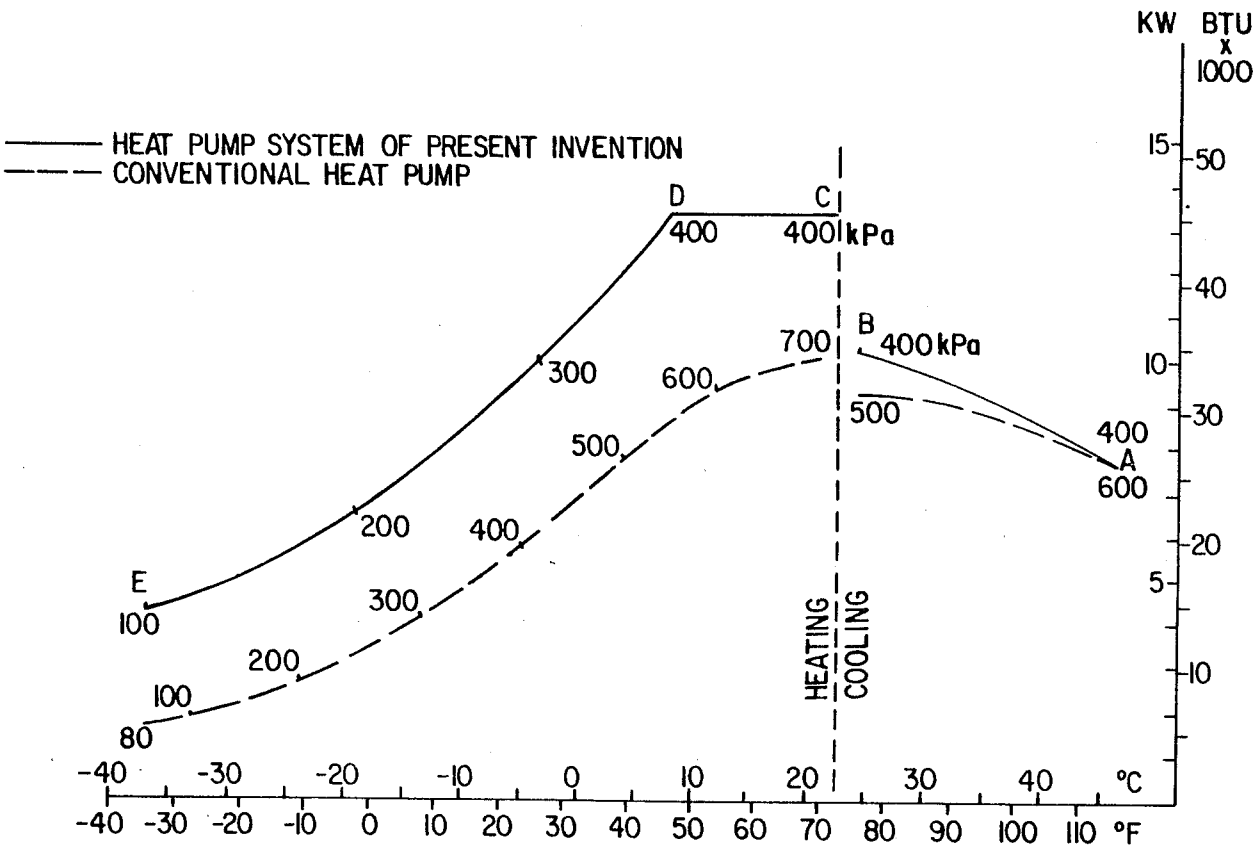
FIG. 3 is a graphical illustration comparing the operation of a heat pump incorporating a pressure limiting device with a conventional heat pump.

The effect of the pressure limiting device 8 and comparison with a conventional system, can be best seen with reference to FIG. 3.

In FIG. 3, the system of the present invention is compared with a conventional system on the basis of the same capacity at a specified high temperature point in the cooling mode, as is common practice. This is represented by point A on FIG. 3. Both of these systems shown have a similar cooling capacity rating and compressor-motor power requirement.

In accordance with the present invention, the pressure limiting device limits pressure to a predetermined maximum (shown as 400 kPa) in the region from D to A. In the lower ambient temperature range of the heating mode (points D to E) at pressures below the predetermined maximum, pressure and capacity are unaffected. In the higher ambient temperature range of the heating mode (points D to C) pressure and capacity are progressively reduced from the normal as temperature increases. Pressure and capacity are reduced for all operations in the cooling mode (points B to A) with maximum reduction at point A, where the maximum loading of the system occurs.

As is evident from FIG. 3, the present invention provides a higher capacity in the heating mode than the conventional system, as desired for northern climates, while having the same power rating as the conventional system.

The pressure reducing device also alleviates the previously mentioned problems associated with system reversal. Upon reversal, the pressure limiting device responds to the pressure closing off the suction line. As the compressor reduces the pressure in the suction line, the pressure limiting device opens slowly, controlling the suction pressure by slowing passing refrigerant to the compressor at a low pressure until the system's pressures are established. This makes unnecessary the use of an accumulator which would otherwise be required to prevent the entry of liquid to the compressor.

I claim:

1. A heat pump system for operating selectively in a heating or cooling mode and including a compressor having an inlet and outlet, an indoor and outdoor heat exchanger, a four-way reversing valve, and a pressure reducing metering device, for use in climates requiring a higher capacity in the heating mode than in the cooling mode, said system comprising a pressure limited device serially connected to the inlet of the compressor, said pressure limiting device comprising pressure responsive means for restricting refrigerant flow as pressure increases and shutting off flow at a predetermined pressure to define a maximum pressure limit, said maximum pressure limit being selected to fall within a predetermined operating pressure range of the system encountered in the heating mode but less that the operating pressures encountered in the cooling mode whereby refrigerant flow, pressure and capacity are reduced for all operation in the cooling mode and whereby the pressure and capacity are unaffected in a lower ambient temperature range of the heating mode.

* * * * *